US011749439B2

(12) United States Patent
Sugawara et al.

(10) Patent No.: US 11,749,439 B2
(45) Date of Patent: Sep. 5, 2023

(54) COMMON MODE CHOKE COIL

(71) Applicant: Mitsubishi Electric Corporation, Tokyo (JP)

(72) Inventors: Retsu Sugawara, Tokyo (JP); Kazutoshi Awane, Tokyo (JP); Yudai Yoneoka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 527 days.

(21) Appl. No.: 17/049,036

(22) PCT Filed: Jul. 17, 2019

(86) PCT No.: PCT/JP2019/001323
§ 371 (c)(1),
(2) Date: Oct. 20, 2020

(87) PCT Pub. No.: WO2020/003565
PCT Pub. Date: Jan. 2, 2020

(65) Prior Publication Data

US 2021/0327629 A1 Oct. 21, 2021

(30) Foreign Application Priority Data

Jun. 28, 2018 (JP) ..... 2018-123064

(51) Int. Cl.
*H01F 27/22* (2006.01)
*H01F 17/06* (2006.01)
(Continued)

(52) U.S. Cl.
CPC ..... *H01F 17/06* (2013.01); *H01F 27/006* (2013.01); *H01F 27/22* (2013.01); *H01F 2017/0093* (2013.01)

(58) Field of Classification Search
CPC ..... H01F 17/06; H01F 27/006; H01F 27/22; H01F 2017/0093; H01F 27/306; H01F 17/062; H01F 27/00–40
See application file for complete search history.

(56) References Cited

U.S. PATENT DOCUMENTS 7,385,466 B2 * 6/2008 Suenaga ..... H01F 17/06 336/215
2007/0075819 A1 * 4/2007 Okuzawa ..... H01F 17/0033 336/200

FOREIGN PATENT DOCUMENTS

CN 105706196 A 6/2016
EP 3 067 903 A1 9/2016
(Continued)

OTHER PUBLICATIONS

Chinese Office Action dated Dec. 2, 2021 in Chinese Application No. 201980041264.2.
(Continued)

*Primary Examiner* — Tuyen T Nguyen
(74) *Attorney, Agent, or Firm* — XSENSUS LLP

(57) ABSTRACT

A common mode choke coil includes: a magnetic core; and a pair of coils wound on a winding portion of the magnetic core, wherein the pair of coils include a first pole coil and a second pole coil which are each wound on the winding portion in a spiral shape by N turns, and wherein the first pole coil and the second pole coil are arranged on the winding portion so that one or more turns of the N turns are adjacent to each other, and each include a parallel running portion and a non-parallel running portion, the first pole coil and the second pole coil overlapping each other in the parallel running portion, and separating from each other in the non-parallel running portion in at least one turn of the
(Continued)

adjacent first pole coil and second pole coil as viewed from the length direction of the winding portion.

6 Claims, 10 Drawing Sheets

(51) Int. Cl.
*H01F 27/00* (2006.01)
*H01F 17/00* (2006.01)

(56) References Cited

FOREIGN PATENT DOCUMENTS

| | | | |
|---|---|---|---|
| JP | 7-29755 | A | 1/1995 |
| JP | 10-163046 | A | 6/1998 |
| JP | 11-214229 | A | 8/1999 |
| JP | 2002-246244 | A | 8/2002 |
| JP | 3509436 | B2 * | 3/2004 |
| JP | 2019-9152 | A | 1/2019 |

OTHER PUBLICATIONS

International Search Report and Written Opinion dated Mar. 5, 2019 for PCT/JP2019/001323 filed on Jan. 17, 2019, 10 pages including English Translation of the International Search Report.
Notice of Reasons for Refusal received for Japanese Patent Application No. 2019-524484, dated Jun. 4, 2019, 11 pages including English Translation.

* cited by examiner

COMMON MODE CHOKE COIL

CROSS-REFERENCE TO RELATED APPLICATIONS

The present application is based on PCT filing PCT/JP2019/001323, filed Jan. 17, 2019, which claims priority to JP 2018-123064, filed Jun. 28, 2018, the entire contents of which are incorporated herein by reference.

TECHNICAL FIELD

The present invention relates to a common mode choke coil which is provided between a power supply and a load device, and which is configured to reduce noise that is generated on the load device side to propagate to the power supply side.

BACKGROUND ART

In a power conversion device configured to control an AC drive motor being a load device, electro-magnetic interference noise (EMI noise) is generated through a high-speed switching operation of an inverter of the power conversion device. This EMI noise flows as a conduction noise through a power supply line and the earth. Thus, there is a risk of the noise being transmitted to other electric devices to exert an adverse effect, for example, cause malfunction thereof. The noise is classified into two types: normal mode noise and common mode noise. The normal mode noise propagates through a transmission path between the power supply and the load device. The common mode noise propagates between the transmission path and the earth. A common mode choke coil has a common mode inductance, and is mainly used to reduce the common mode noise. However, the common mode choke coil also has a normal mode inductance caused by a leakage magnetic flux, that is, a leakage inductance, and thus is effective for reduction of the normal mode noise as well.

In general, a common mode choke coil includes a magnetic core and a pair of coils, and has a sectional-winding configuration in which the pair of coils are separately wound on the magnetic core. However, in this configuration, when a large current flows through the common mode choke coil, the magnetic core is magnetically saturated and the common mode inductance is reduced.

To deal with the above, there has been hitherto proposed a method of suppressing magnetic saturation in a common mode choke coil including a magnetic core and a pair of coils through application of bifilar winding to the pair of coils (for example, see Patent Literature 1).

In the related-art common mode choke coil of Patent Literature 1, the bifilar winding is adopted to cancel magnetic fluxes generated from the pair of coils, to thereby suppress magnetic saturation of the magnetic core. However, the leakage magnetic flux is reduced, and hence the normal mode inductance is reduced. This leads to deterioration in performance of reducing normal mode noise.

In view of such circumstances, there has been proposed a method of improving performance of reducing normal mode noise while suppressing magnetic saturation in a common mode choke coil including a magnetic core and a pair of coils, through combined use of bifilar winding and sectional winding (for example, see Patent Literatures 2 and 3).

CITATION LIST

Patent Literature

[PTL 1] JP 07-029755 A
[PTL 2] JP 11-214229 A
[PTL 3] JP 2002-246244 A

SUMMARY OF INVENTION

Technical Problem

In the related-art common mode choke coils of Patent Literatures 2 and 3, in order to improve the performance of reducing normal mode noise while suppressing magnetic saturation, the bifilar winding and the sectional winding are used in combination to form the pair of coils. This causes a problem in that a winding portion is extended in a length direction of a magnetic path of the magnetic core, and the magnetic core is therefore enlarged.

The present invention has been made to solve the above-mentioned problem, and has an object to obtain a common mode choke coil of a small size with which it is possible to suppress magnetic saturation and also improve performance of reducing normal mode noise without extending a winding portion in a length direction of a magnetic path.

Solution to Problem

According to one embodiment of the present invention, there is provided a common mode choke coil including: a magnetic core; and a pair of coils wound on a winding portion of the magnetic core. The pair of coils include a first pole coil and a second pole coil which are each wound on the winding portion in a spiral shape by N turns in a length direction of the winding portion, and the first pole coil and the second pole coil are arranged on the winding portion so that one or more turns of the N turns are adjacent to each other, and the first pole coil and the second pole coil each include a parallel running portion and a non-parallel running portion, the first pole coil and the second pole coil overlapping each other in the parallel running portion, and separating from each other in a direction orthogonal to the length direction of the winding portion in the non-parallel running portion in at least one turn of the adjacent first pole coil and second pole coil as viewed from the length direction of the winding portion, where N is an integer of 1 or more.

Advantageous Effects of Invention

According to the present invention, the first pole coil and the second pole coil that form the pair of coils are arranged on the winding portion so that one or more turns of the N turns are adjacent to each other. Thus, it is possible to suppress the magnetic saturation without extending the winding portion in the length direction of the magnetic path.

The first pole coil and the second pole coil each include the parallel running portion and the non-parallel running portion, the first pole coil and the second pole coil overlapping each other in the parallel running portion, and separating from each other in the direction orthogonal to the length direction of the winding portion in the non-parallel running portion in at least one turn of the adjacent first pole coil and second pole coil as viewed from the length direction of the winding portion. Thus, the non-parallel running portion contributes to the normal mode inductance, and the performance of reducing normal mode noise can be therefore improved.

DESCRIPTION OF EMBODIMENTS

A common mode choke coil according to preferred embodiments of the present invention is now described in detail with reference to the accompanying drawings.

First Embodiment

Figure 1:
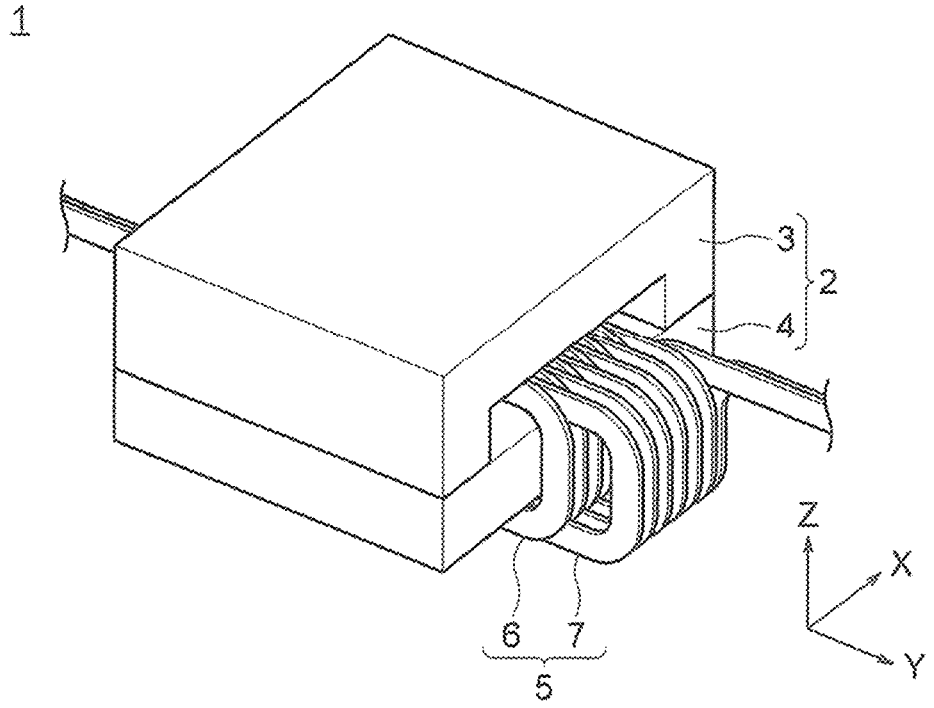
FIG. 1 is a perspective view for illustrating a common mode choke coil according to a first embodiment of the present invention.
Figure 2:
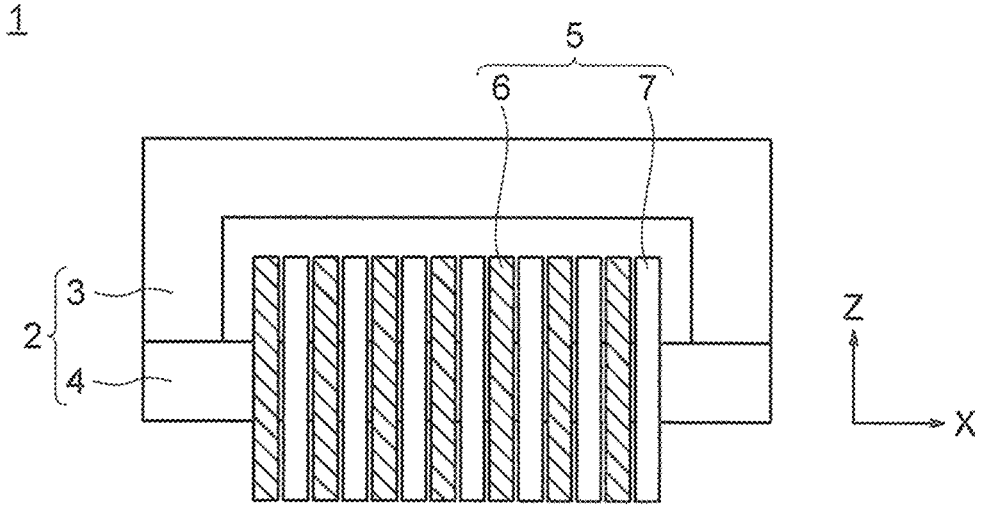
FIG. 2 is a front view for illustrating the common mode choke coil according to the first embodiment of the present invention.
Figure 3:
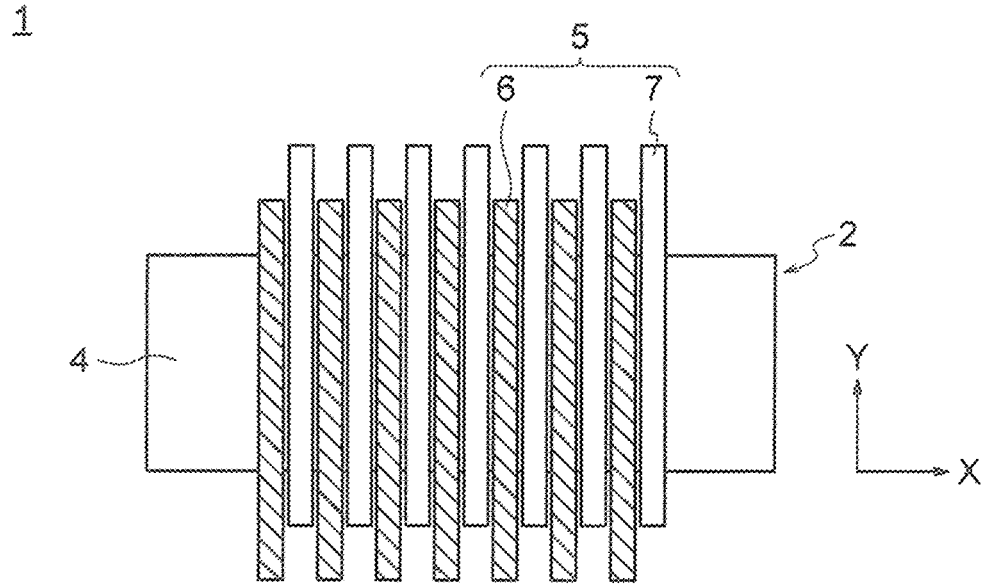
FIG. 3 is a bottom view for illustrating the common mode choke coil according to the first embodiment of the present invention.
Figure 4:
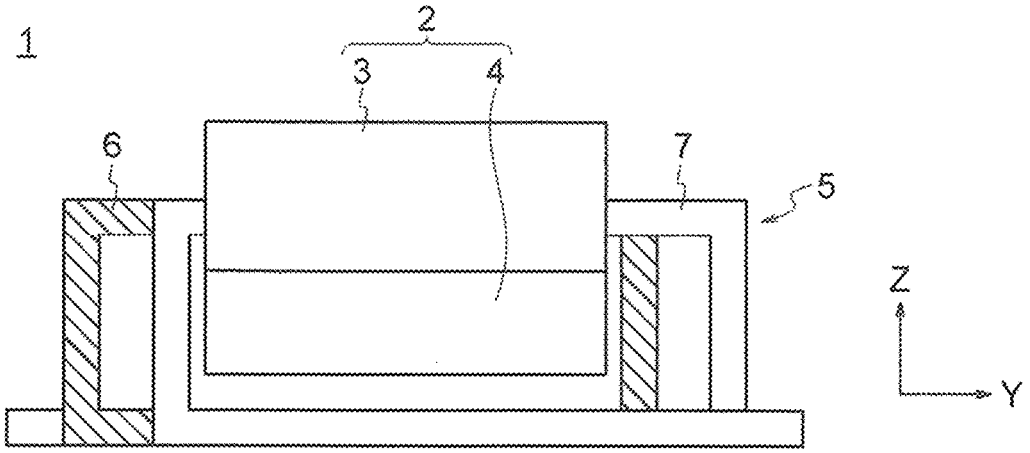
FIG. 4 is a side view for illustrating the common mode choke coil according to the first embodiment of the present invention.
Figure 5:
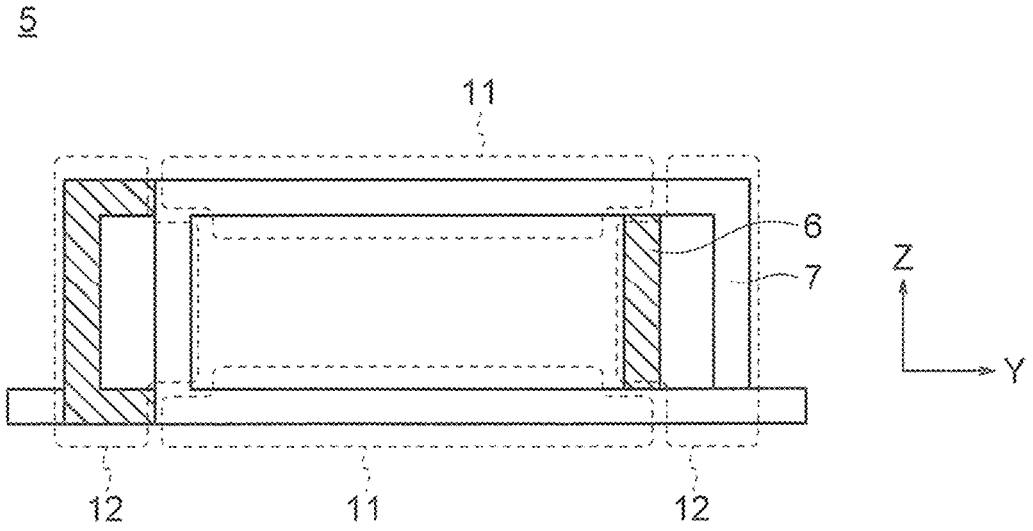
FIG. 5 is a side view for illustrating a pair of coils in the common mode choke coil according to the first embodiment of the present invention.

FIG. 1 is a perspective view for illustrating a common mode choke coil according to a first embodiment for carrying out the present invention. FIG. 2 is a front view for illustrating the common mode choke coil according to the first embodiment. FIG. 3 is a bottom view for illustrating the common mode choke coil according to the first embodiment. FIG. 4 is a side view for illustrating the common mode choke coil according to the first embodiment. FIG. 5 is a side view for illustrating a pair of coils in the common mode choke coil according to the first embodiment.

In FIG. 1 to FIG. 5, a common mode choke coil 1 includes a magnetic core 2 and a pair of coils 5. The magnetic core 2 includes a U-shaped core 3 and an I-shaped core 4. The pair of coils 5 include a positive pole coil 6 being a first pole coil and a negative pole coil 7 being a second pole coil. In the drawings, the X direction corresponds to a length direction of a magnetic path of the magnetic core 2. The length direction of the magnetic path of the magnetic core 2 is a direction of a magnetic flux passing through the I-shaped core 4 being a winding portion for the pair of coils 5, that is, a length direction of the I-shaped core 4. The Z direction is a direction orthogonal to the X direction, that is, a direction in which the U-shaped core 3 is connected to the I-shaped core 4. The Y direction is a direction orthogonal to the X direction and the Z direction.

The U-shaped core 3 and the I-shaped core 4 are formed of ferrite or other such magnetic materials. The magnetic core 2 is provided so that the I-shaped core 4 connects both leg portions of the U-shaped core 3, to thereby form a closed magnetic path. The positive pole coil 6 and the negative pole coil 7 are formed by winding a copper rectangular conductor on the I-shaped core 4 in seven turns each in a spiral shape so that respective turn portions are alternately arranged in the X direction. The positive pole coil 6 and the negative pole coil 7 are formed into the same coil shape, and wound on the I-shaped core 4 while being displaced in the Y direction in FIG. 4. With this arrangement, the positive pole coil 6 and the negative pole coil 7 each include, as illustrated in FIG. 5, parallel running portions 11 being overlapping regions and non-parallel running portions 12 being non-overlapping regions. The positive pole coil 6 and the negative pole coil 7 overlap each other in the overlapping regions, and do not overlap each other in the non-overlapping regions as viewed from the X direction. Here, the non-overlapping regions in which the positive pole coil 6 and the negative pole coil 7 do not overlap each other as viewed from the X direction are regions in which the positive pole coil 6 and the negative pole coil 7 are separated from each other in the direction orthogonal to the X direction. The X direction can be also referred to as a coil axis direction of the pair of coils 5 that are wound in the spiral shape.

In the common mode choke coil 1 of the first embodiment, the positive pole coil 6 and the negative pole coil 7 that form the pair of coils 5 are wound on the I-shaped core 4 in the spiral shape so that the respective turn portions are alternately arranged in the X direction. That is, the pair of coils 5 have a bifilar-winding configuration. Thus, the common mode choke coil 1 can have a smaller size in the X direction to be downsized as compared with the related-art common mode choke coils of Patent Literatures 2 and 3 in which a pair of coils are configured through combined use of bifilar winding and sectional winding.

Figure 6:
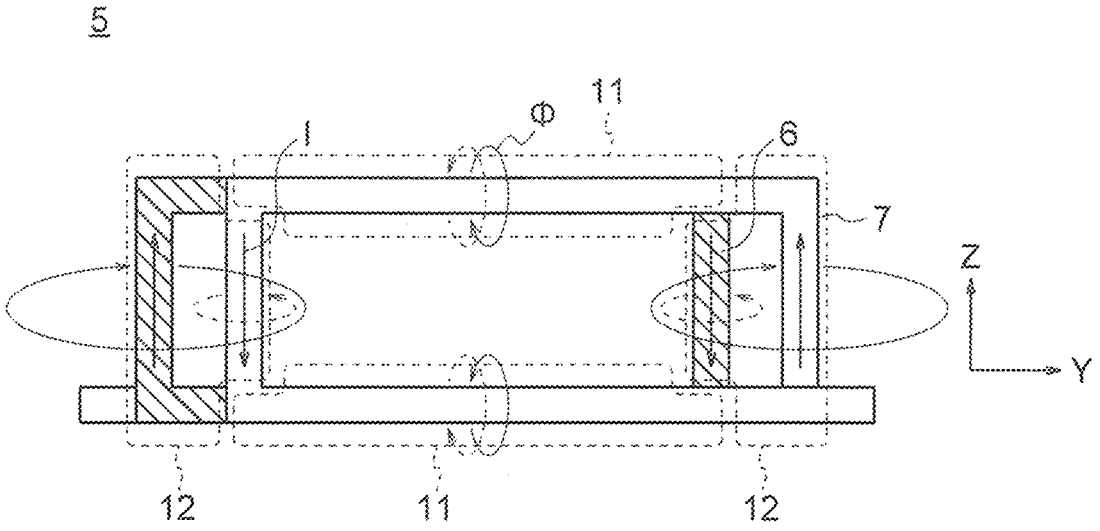
FIG. 6 is a schematic view for illustrating currents flowing through coils of the common mode choke coil according to the first embodiment of the present invention, and magnetic fluxes generated by the currents.

Next, with reference to FIG. 6, description is given of an effect produced by the positive pole coil 6 and the negative pole coil 7 each including the parallel running portions and the non-parallel running portions 12. FIG. 6 is a schematic view for illustrating currents flowing through the coils of the common mode choke coil according to the first embodiment, and magnetic fluxes generated by the currents. In FIG. 6, I represents a current and Φ represents a magnetic flux.

In each parallel running portion 11, the currents I flow close to each other in opposite directions through the positive pole coil 6 and the negative pole coil 7. Thus, the magnetic fluxes Φ generated by the currents I flowing through the positive pole coil 6 and the negative pole coil 7 cancel each other, to thereby suppress magnetic saturation of the magnetic core 2. It should be noted here that the parallel running portions 11 less contribute to the normal mode inductance.

Meanwhile, in each non-parallel running portion 12, the currents I flow apart from each other in opposite directions through the positive pole coil 6 and the negative pole coil 7. Thus, a part of the magnetic fluxes Φ generated by the currents I flowing through the positive pole coil 6 and the negative pole coil 7 remains uncanceled and contributes to the normal mode inductance. It should be noted here that the non-parallel running portions 12 less contribute to suppressing the magnetic saturation of the magnetic core 2.

In this way, in the common mode choke coil 1, the pair of coils 5 include the parallel running portions 11 that contribute to suppressing the magnetic saturation of the magnetic core 2 and the non-parallel running portions 12 that contribute to the normal mode inductance. Thus, the common mode choke coil 1 can suppress the magnetic saturation of the magnetic core 2 to improve performance of reducing normal mode noise.

Figure 7:
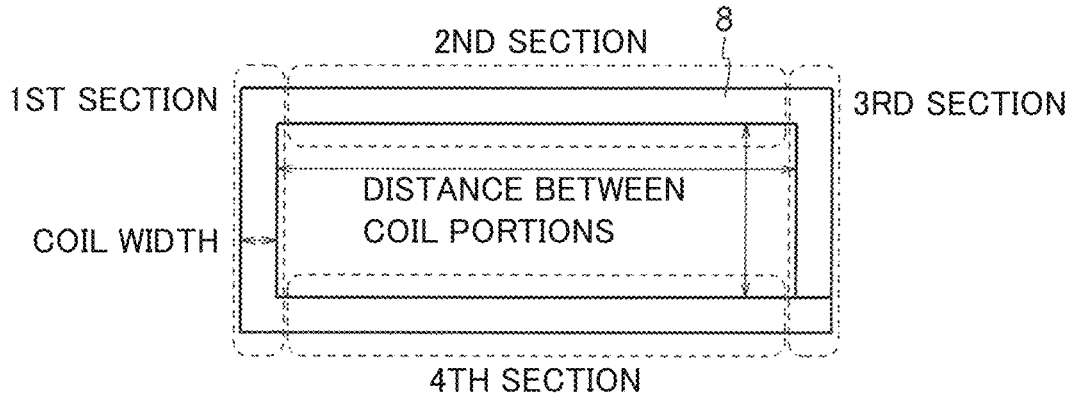
FIG. 7 is a schematic view for illustrating a shape of a one-turn coil.

Now, the normal mode inductance in the first embodiment is compared with normal mode inductance in Patent Literature 1 in which bifilar winding is applied to a pair of coils. FIG. 7 is a schematic view for illustrating a shape of a one-turn coil 8.

A partial self-inductance and partial mutual inductance of the one-turn coil 8 are expressed by Expression 1.

$$L_{pij} = \frac{\mu_0}{2\pi} l \left\{ \ln\left[ \frac{l}{d} + \sqrt{\left(\frac{l}{d}\right)^2 + 1} \right] + \frac{d}{l} - \sqrt{\left(\frac{d}{l}\right)^2 + 1} \right\} \quad \text{(Expression 1)}$$

In Expression 1, i and j each take any value of 1, 2, 3, and 4 and correspond to section numbers given in FIG. 7, $L_{pij}$ represents a partial self-inductance when i=j is satisfied, and represents a partial mutual inductance when i≠j is satisfied, $\mu_0$ represents a magnetic permeability in a vacuum, l represents a length of the coil 8, and d represents a width of the coil 8 when i=j is satisfied, and represents a distance between portions of the coil 8 in an i-th section and a j-th section when i≠j is satisfied. In this case, a loop inductance of the one-turn coil 8 is expressed by Expression 2.

$$L_{loop} = \Sigma_{i=j} L_{pij} - \Sigma_{i \neq j} L_{pij} \quad \text{(Expression 2)}$$

As illustrated in FIG. 7, assuming that a width of the coil 8 in each section is 2 mm, a distance between portions of the coil 8 in first and third sections is 50 mm, and a distance between portions of the coil 8 in second and fourth sections is 20 mm, $L_{loop}$ is 54.8 nH. Considering that in the first embodiment, the positive pole coil 6 and the negative pole coil 7 each have seven turns, and two coils, namely, the positive pole coil 6 and the negative pole coil 7, are provided, the normal mode inductance is derived as follows: 54.8 nH×7×2=767 nH.

It should be noted here that this value is obtained without considering an influence of each parallel running portion 11 of the coils in this embodiment, or adjacent coils in the bifilar winding described in Patent Literature 1.

The partial mutual inductance is derived from calculation of only that in a combination of the first and third sections and that in a combination of the second and fourth sections. This is because the partial mutual inductance in the combination of the first and second sections and that in the combination of the third and fourth sections become 0 with the direction of vector potential and the direction of the coil 8 being orthogonal to each other.

Figure 8:
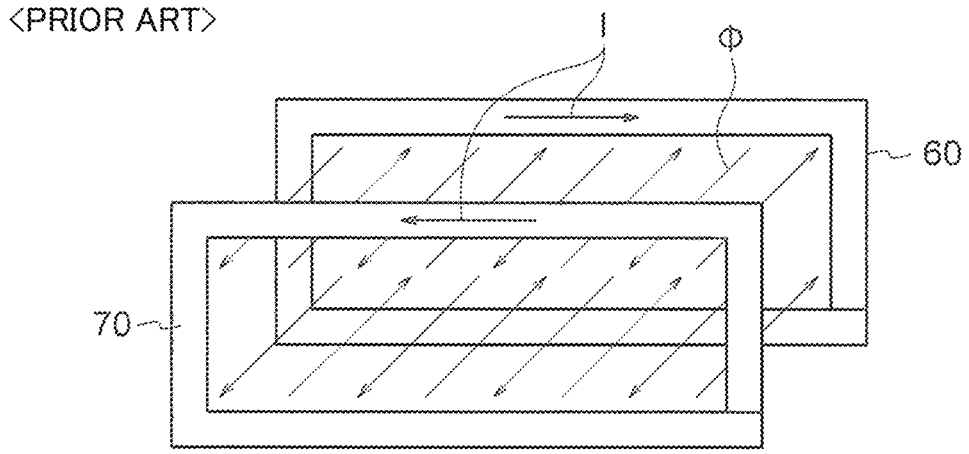
FIG. 8 is a schematic view for illustrating interlinking magnetic fluxes from adjacent coils in a related-art common mode choke coil described in Patent Literature 1.
Figure 9:
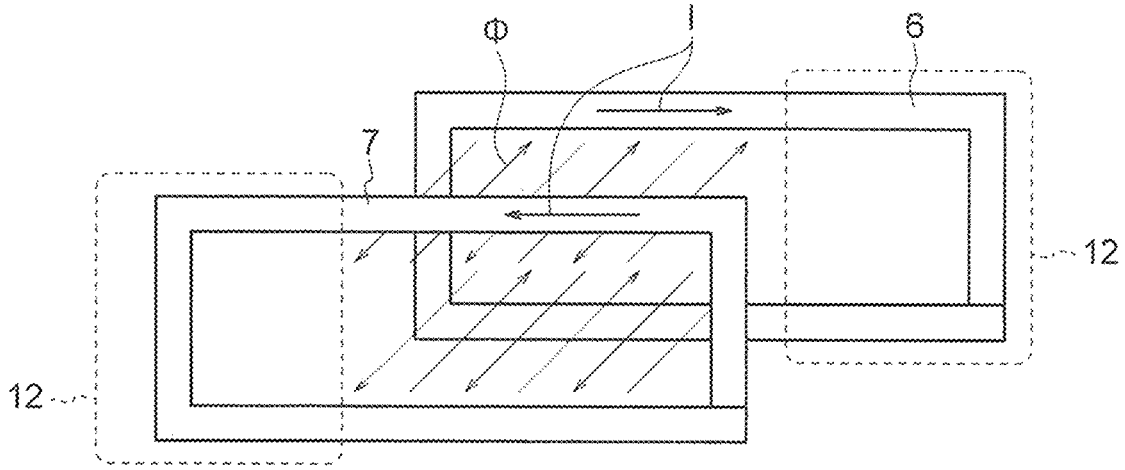
FIG. 9 is a schematic view for illustrating interlinking magnetic fluxes from adjacent coils in the common mode choke coil according to the first embodiment of the present invention.

Next, comparison of the normal mode inductance is made in consideration of an influence of adjacent coils. FIG. is a schematic view for illustrating interlinking magnetic fluxes from adjacent coils in the related-art common mode choke coil described in Patent Literature 1. FIG. 9 is a schematic view for illustrating interlinking magnetic fluxes from adjacent coils in the common mode choke coil according to the first embodiment. Here, positive pole coils 60 and 70 of FIG. 8 are formed into the same coil shape as those of the positive pole coil 6 and the negative pole coil 7.

Expression 3 defines a relationship between a loop inductance of each coil and the magnetic flux interlinking with each coil.

$$L_{loop} = \frac{\Phi}{I} = \int_s \vec{B} \cdot d\vec{s}/I \quad \text{(Expression 3)}$$

In Expression 3, 0 represents a magnetic flux interlinking with each coil, B represents a density of a magnetic flux interlinking with each coil, s represents a plane surrounded by each coil, and I represents a current flowing through each coil.

In the related-art common mode choke coil of Patent Literature 1, the bifilar-wound positive pole coil 60 and negative pole coil 70 have only an overlapping region in which the coils overlap each other as viewed from the X direction. That is, in the related-art common mode choke coil, the positive pole coil 60 and the negative pole coil 70 have only the parallel running portion 11, and do not have the non-parallel running portion 12. As illustrated in FIG. 8, the currents I flow through the adjacent positive pole coil 60 and negative pole coil 70 in opposite directions, and directions of the magnetic fluxes Φ interlinking with the respective coils are opposite to each other. Thus, the magnetic fluxes Φ interlinking with the adjacent positive pole coil 60 and negative pole coil 70 cancel each other. Assuming that a proportion of the canceled magnetic flux Φ in the total magnetic flux Φ interlinking with the positive pole coil 60 and the negative pole coil 70 is represented by n, a value of $L_{loop}$, that is, the normal mode inductance becomes a (1−n)-fold value. Here, n satisfies 0<n<1. For example, assuming that n is 0.9, the normal mode inductance calculated from Expression 2 above is derived as follows: 767 nH×(1−0.9)=76.7 nH.

In the common mode choke coil 1 of the first embodiment, the positive pole coil 6 and the negative pole coil 7 each include the parallel running portions 11 and the non-parallel running portions 12, and hence an opposing area of the adjacent positive pole coil 6 and negative pole coil 7 is reduced by an area of the non-parallel running portions 12 thus provided. Here, it is assumed that with the presence of the non-parallel running portions 12, an opposing area of the adjacent positive pole coil 6 and negative pole coil 7 is m times as large as an opposing area of the adjacent positive pole coils 60 and 70 having only the parallel running portion 11. Then, a proportion of the canceled magnetic flux Φ in the total magnetic flux Φ interlinking with the adjacent positive pole coil 6 and negative pole coil 7 becomes a (n×m)-fold value. Here, m satisfies 0<m<1. As compared with the case of Patent Literature 1 in which an opposing area of the positive pole coils 60 and 70 is 20 mm×50 mm, in the first embodiment, an opposing area of the positive pole coil 6 and the negative pole coil 7 is 20 mm×45 mm with the provision of the non-parallel running portions 12. Thus, m is 0.9. Also in the first embodiment, assuming that n is 0.9, the normal mode inductance is derived as follows: 767 nH×(1−0.9×0.9) =146 nH. As described above, it can be understood that, according to the first embodiment, the normal mode inductance can be improved compared with Patent Literature 1 in which bifilar winding having only the parallel running portion 11 is applied to a pair of coils.

In this example, for simple calculation, the magnetic flux density B is assumed to be perpendicular to the plane surrounded by each of the positive pole coil 6 and the negative pole coil 7 and to be constant at any position.

As described above, according to the first embodiment, the pair of coils 5 include the positive pole coil 6 and the negative pole coil 7 that are wound on the I-shaped core 4 of the magnetic core 2 in a spiral shape so that the respective turn portions are alternately arranged in the X direction. The positive pole coil 6 and the negative pole coil 7 each include the parallel running portions 11 that contribute to suppressing magnetic saturation and the non-parallel running portions 12 that contribute to the normal mode inductance. Thus, the common mode choke coil 1 of a small size can be achieved, which can suppress magnetic saturation and improve the performance of reducing the normal mode noise without extending the magnetic core 2 in the X direction.

In the first embodiment described above, it is assumed that the positive pole coil 6 and the negative pole coil 7 are formed into the same coil shape, but the positive pole coil 6 and the negative pole coil 7 may be formed into different coil shapes.

Further, in the first embodiment described above, the adjacent positive pole coil 6 and negative pole coil 7 each include the parallel running portions 11 and the non-parallel running portions 12 in all seven turns, but the adjacent positive pole coil 6 and the negative pole coil 7 are only required to include the parallel running portions 11 and the non-parallel running portions 12 in at least one turn of the seven turns.

Second Embodiment

Figure 10:
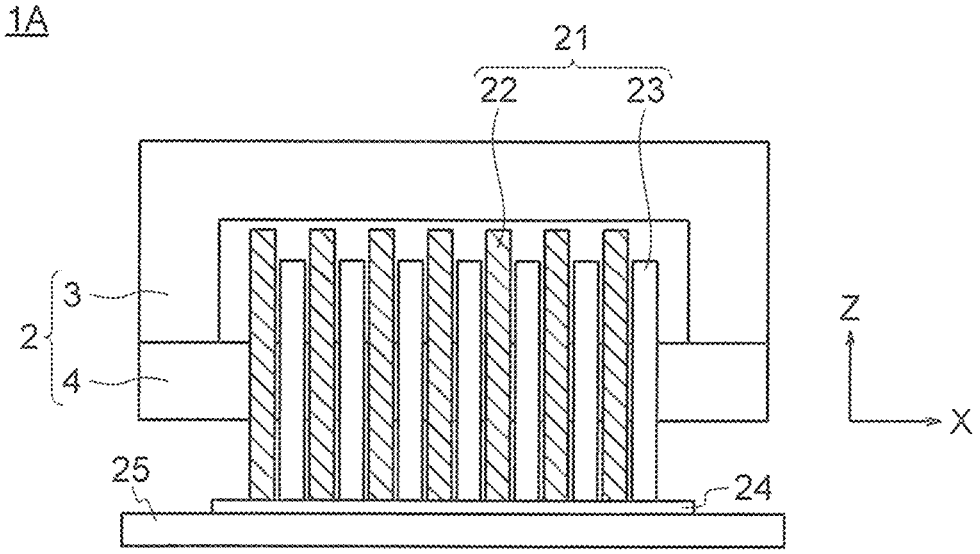
FIG. 10 is a front view for illustrating a common mode choke coil according to a second embodiment of the present invention.
Figure 11:
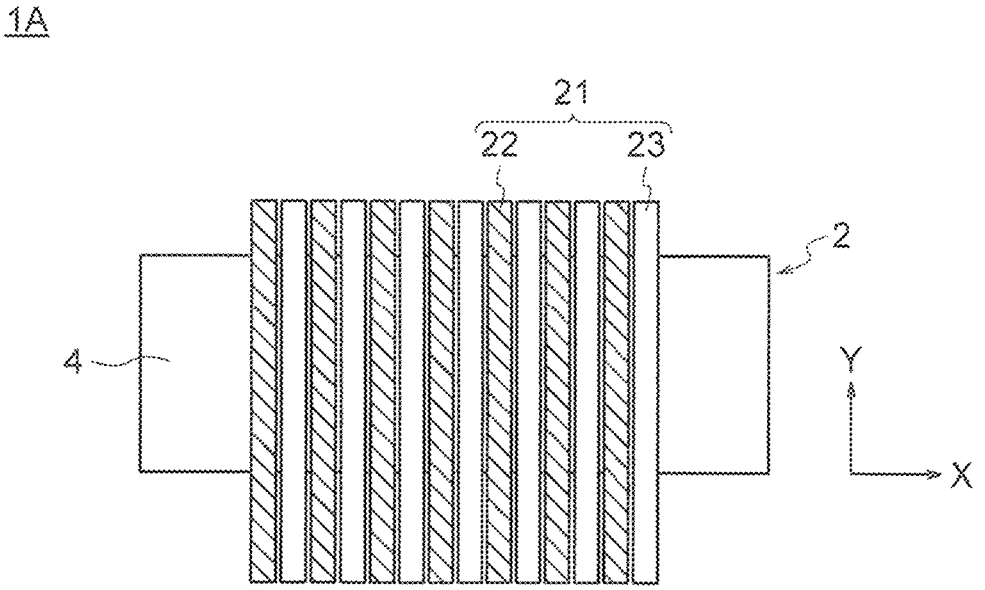
FIG. 11 is a bottom view for illustrating the common mode choke coil according to the second embodiment of the present invention.
Figure 12:
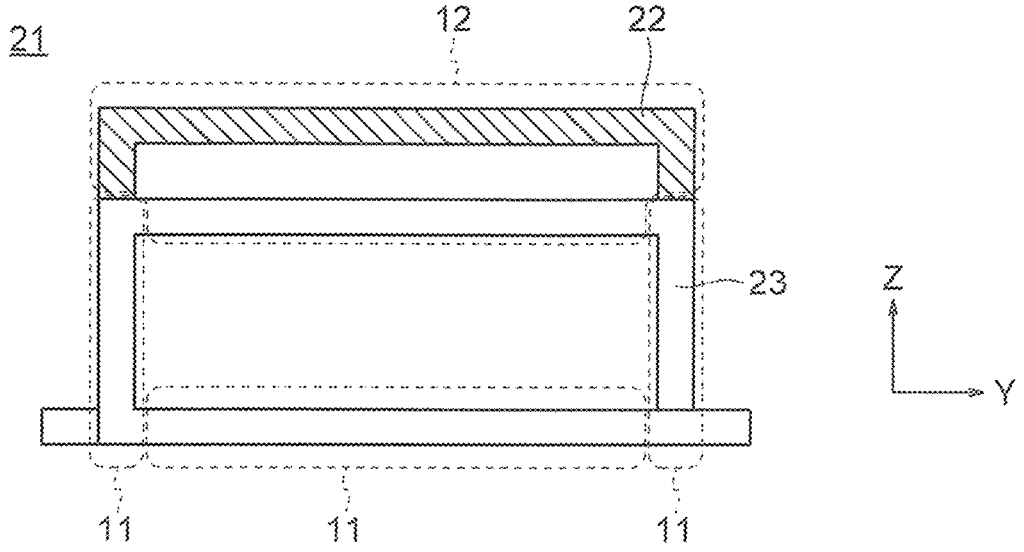
FIG. 12 is a side view for illustrating a pair of coils in the common mode choke coil according to the second embodiment of the present invention.
Figure 13:
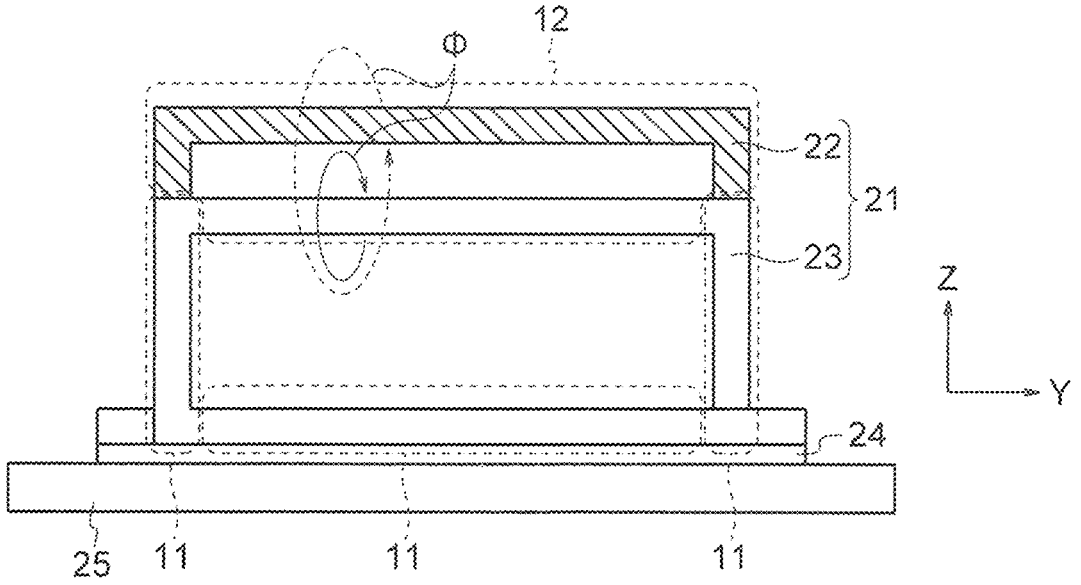
FIG. 13 is a side view for illustrating the pair of coils and a metal casing in the common mode choke coil according to the second embodiment of the present invention.
Figure 14:
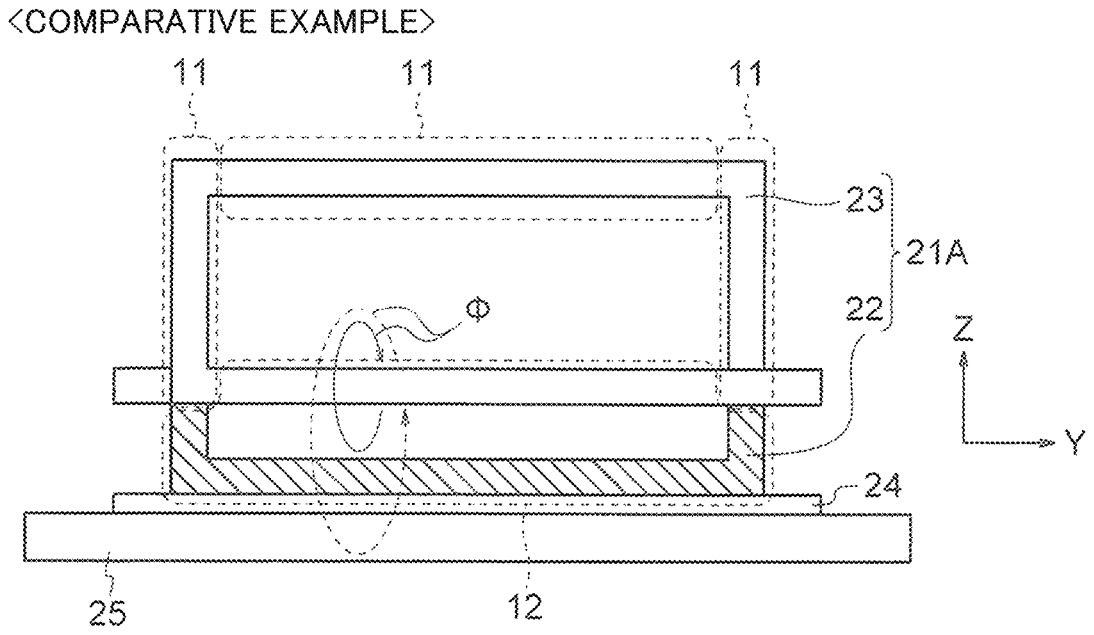
FIG. 14 is a side view for illustrating a pair of coils and a metal casing in a common mode choke coil of a comparative example.

FIG. 10 is a front view for illustrating a common mode choke coil according to a second embodiment for carrying out the present invention. FIG. 11 is a bottom view for illustrating the common mode choke coil according to the second embodiment. FIG. 12 is a side view for illustrating a pair of coils in the common mode choke coil according to the second embodiment. FIG. 13 is a side view for illustrating the pair of coils and a metal casing in the common mode choke coil according to the second embodiment. FIG. 14 is a side view for illustrating a pair of coils and a metal casing in a common mode choke coil of a comparative example.

In FIG. 10 to FIG. 12, a pair of coils 21 include a positive pole coil 22 being a first pole coil and a negative pole coil 23 being a second pole coil. The positive pole coil 22 has a turn portion of a larger shape than that of a turn portion of the negative pole coil 23 in the Z direction. The positive pole coil 22 and the negative pole coil 23 are wound on the I-shaped core 4 in seven turns each so that the respective turn portions are alternately arranged in the X direction. A metal casing 25 being a metal member is provided on an opposite side to the U-shaped core 3, of the I-shaped core 4 in the Z direction. The positive pole coil 22 and the negative pole coil 23 are arranged so that outer peripheral portions located on an opposite side to the U-shaped core 3, of the I-shaped core 4 in the Z direction are brought into contact with the metal casing 25 via an insulator 24 of a flat plate shape, and thus are held by the metal casing 25. The positive pole coil 22 thus protrudes to an opposite side to the metal casing 25 in the Z direction with respect to the negative pole coil 23. With this arrangement, the positive pole coil 22 and the negative pole coil 23 each include, as illustrated in FIG. 12, parallel running portions 11 being overlapping regions and a non-parallel running portion 12 being a non-overlapping region. The positive pole coil 22 and the negative pole coil 23 overlap each other in the overlapping regions, and do not overlap each other in the non-overlapping region as viewed from the X direction. In this example, the metal casing 25 is made of a metal material such as copper, iron, or aluminum.

The remaining configuration is the same as that of the first embodiment described above.

In a common mode choke coil 1A of the second embodiment, the positive pole coil 22 and the negative pole coil 23 are wound on the I-shaped core 4 of the magnetic core 2 in a spiral shape so that the respective turn portions are alternately arranged in the X direction. Further, the positive pole coil 22 and the negative pole coil 23 each include the parallel running portions 11 that contribute to suppressing magnetic saturation, and the non-parallel running portion 12 that contributes to the normal mode inductance. Therefore, also in the second embodiment, the same effects as those in the first embodiment described above are obtained.

In each parallel running portion 11, the magnetic fluxes Φ generated by currents flowing through the adjacent positive pole coil 22 and negative pole coil 23 cancel each other. Meanwhile, in the non-parallel running portion 12, the magnetic fluxes Φ generated by currents flowing through the adjacent positive pole coil 22 and negative pole coil 23 do not cancel each other. Thus, as illustrated in FIG. 13 and FIG. 14, a leakage magnetic flux is generated.

In the common mode choke coil of the comparative example, as illustrated in FIG. 14, the non-parallel running portion 12 of the pair of coils 21A is provided closer to the metal casing 25. With this arrangement, the leakage magnetic flux interlinks with the metal casing 25, and thus is interrupted. Consequently, its contribution to the normal mode inductance is lowered.

In contrast, in the common mode choke coil 1A of the second embodiment, as illustrated in FIG. 13, the non-parallel running portion 12 of the pair of coils 21 is provided apart from the metal casing 25. With this arrangement, the leakage magnetic flux does not interlink with the metal casing 25, and thus is not interrupted. Consequently, its contribution to the normal mode inductance is increased.

As described above, according to the second embodiment, the non-parallel running portion 12 of the pair of coils 21 is provided apart from the metal casing 25. Thus, the leakage magnetic flux in the non-parallel running portion 12 does not interlink with the metal casing 25, and hence the normal mode inductance is more effectively improved compared with the case in which the leakage magnetic flux interlinks with the metal casing 25.

In the second embodiment described above, the metal casing 25 is provided on the opposite side to the U-shaped core 3, of the I-shaped core 4 of the pair of coils 21, but the metal casing 25 may be provided on the U-shaped core 3 side of the I-shaped core 4 of the pair of coils 21 or on one side of the pair of coils 21 in the Y direction. Also in this case, the non-parallel running portion 12 is provided on an opposite side to the metal casing 25, of the I-shaped core 4.

Further, in the second embodiment described above, the dedicated metal casing 25 is used as the metal member for holding the pair of coils 21, but the metal member may be a casing of a device to which the common mode choke coil is mounted, a heat sink configured to cool the common mode choke coil, or a ground for a substrate to which the common mode choke coil is mounted, for example. Also in this case, the pair of coils are held by such a metal member via an insulator. Further, the non-parallel running portion 12 of the pair of coils 21 is only required to be provided on an opposite side to the metal member such as the casing, the heat sink, or the ground for the substrate, of the I-shaped core.

Third Embodiment

Figure 15:
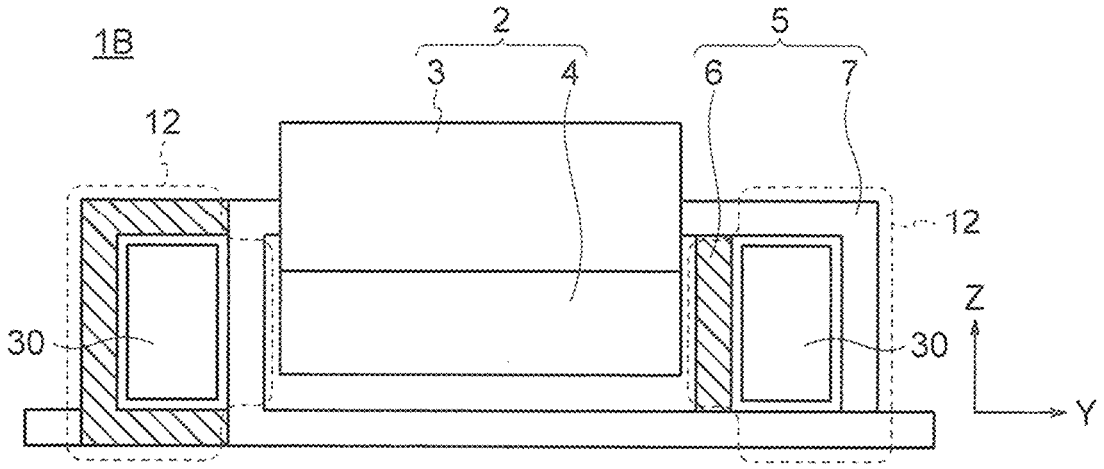
FIG. 15 is a side view for illustrating a common mode choke coil according to a third embodiment of the present invention.

FIG. 15 is a side view for illustrating a common mode choke coil according to a third embodiment for carrying out the present invention.

In FIG. 15, auxiliary magnetic cores 30 formed into a rectangular column shape are each inserted into a space surrounded by the positive pole coil 6 and the negative pole coil 7 in non-parallel running portions 12 so as to extend from one end to the other end of the space in the X direction.

The remaining configuration is the same that of as the first embodiment described above.

Also in a common mode choke coil 1B of the third embodiment, the positive pole coil 6 and the negative pole coil 7 are wound on the I-shaped core 4 of the magnetic core 2 in a spiral shape so that the respective turn portions are alternately arranged in the X direction. Further, the positive pole coil 6 and the negative pole coil 7 each include parallel running portions 11 that contribute to suppressing magnetic saturation, and the non-parallel running portions 12 that contribute to the normal mode inductance. Therefore, also in the third embodiment, the same effects as those in the first embodiment described above are obtained.

In the common mode choke coil 1B, the auxiliary magnetic cores 30 are each provided in the space surrounded by the positive pole coil 6 and the negative pole coil 7 in the non-parallel running portions 12. With this arrangement, the common mode choke coil 1B of the third embodiment can more effectively improve the normal mode inductance without increasing its volume compared with the first embodiment in which the auxiliary magnetic cores 30 are not inserted into the space surrounded by the positive pole coil 6 and the negative pole coil 7 in the non-parallel running portions 12.

In the third embodiment described above, the auxiliary magnetic cores 30 are provided in the space surrounded by the positive pole coil 6 and the negative pole coil 7 in the non-parallel running portions 12 in the common mode choke coil 1 of the first embodiment, but even when the auxiliary magnetic core 30 is provided in the space surrounded by the positive pole coil and the negative pole coil in the non-parallel running portion in the common mode choke coil of the other embodiments, the same effects can be obtained.

Further, in the third embodiment, the auxiliary magnetic cores 30 may be formed of the same magnetic material as, or a different magnetic material from that of the magnetic core 2.

Fourth Embodiment

Figure 16:
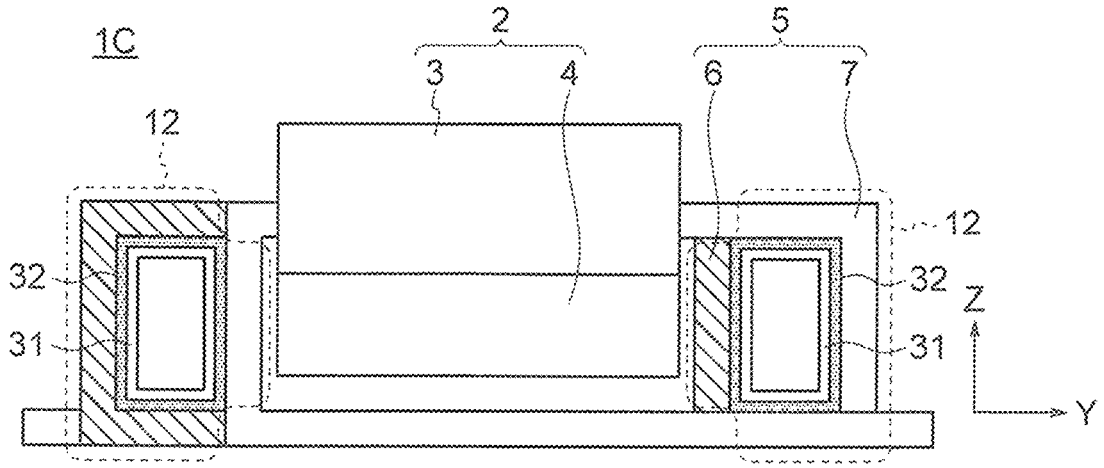
FIG. 16 is a side view for illustrating a common mode choke coil according to a fourth embodiment of the present invention.

FIG. 16 is a side view for illustrating a common mode choke coil according to a fourth embodiment for carrying out the present invention.

In FIG. 16, metal plates 31 being heat radiating members having a rectangular cylinder structure are each inserted into a space surrounded by the positive pole coil 6 and the negative pole coil 7 in non-parallel running portions 12 so as to extend from one end to the other end of the space in the X direction. Further, the metal plates 31 are each inserted into the space under a state of being in contact, via an insulator 32, with inner peripheral wall surfaces of the positive pole coil 6 and the negative pole coil 7 that define the space. In this example, copper, iron, aluminum, or another metal material is used for the metal plate 31.

The remaining configuration is the same as that of the first embodiment described above.

Also in a common mode choke coil 1C of the fourth embodiment, the positive pole coil 6 and the negative pole coil 7 are wound on the I-shaped core 4 of the magnetic core 2 in a spiral shape so that the respective turn portions are alternately arranged in the X direction. Further, the positive pole coil 6 and the negative pole coil 7 each include parallel running portions 11 that contribute to suppressing magnetic saturation, and the non-parallel running portions 12 that contribute to the normal mode inductance. Therefore, also in the fourth embodiment, the same effects as those in the first embodiment described above are obtained.

In the common mode choke coil 1C, the metal plates 31 are each provided in the space surrounded by the positive pole coil 6 and the negative pole coil 7 in the non-parallel running portions 12 so as to be in contact with the positive pole coil 6 and the negative pole coil 7 via the insulator 32. Thus, the common mode choke coil 1C of the fourth embodiment can improve heat radiating property of the pair of coils 5 without increasing its volume compared with the first embodiment in which the metal plates 31 are not provided in the space surrounded by the positive pole coil 6 and the negative pole coil 7 in the non-parallel running portions 12. Further, the metal plates 31 do not interrupt the leakage magnetic flux generated from the non-parallel running portions 12, and hence an effect of improving the normal mode inductance, which is achieved through the provision of the non-parallel running portions 12, is not inhibited.

In the fourth embodiment described above, the metal plates 31 are each inserted into the space surrounded by the positive pole coil 6 and the negative pole coil 7 in the non-parallel running portions 12 in the common mode choke coil 1 of the first embodiment, but even when the metal plate 31 is inserted into the space surrounded by the positive pole coil and the negative pole coil in the non-parallel running portion in the common mode choke coil of the other embodiments, the same effects can be obtained.

Further, in the fourth embodiment described above, each of the metal plates 31 is hollow inside, but a resin material may be filled into the inside of each of the metal plates 31, or the auxiliary magnetic core 30 in the third embodiment may be inserted into the inside of each of the metal plates 31.

Further, in the first to fourth embodiments described above, the positive pole coil and the negative pole coil are wound on the I-shaped core in seven turns each in a spiral shape so that the respective turn portions are alternately arranged in the X direction, but the number of turns of the positive pole coil and the negative pole coil is not limited to seven, and it is only required that a plurality of turns be arranged.

Fifth Embodiment

Figure 17:
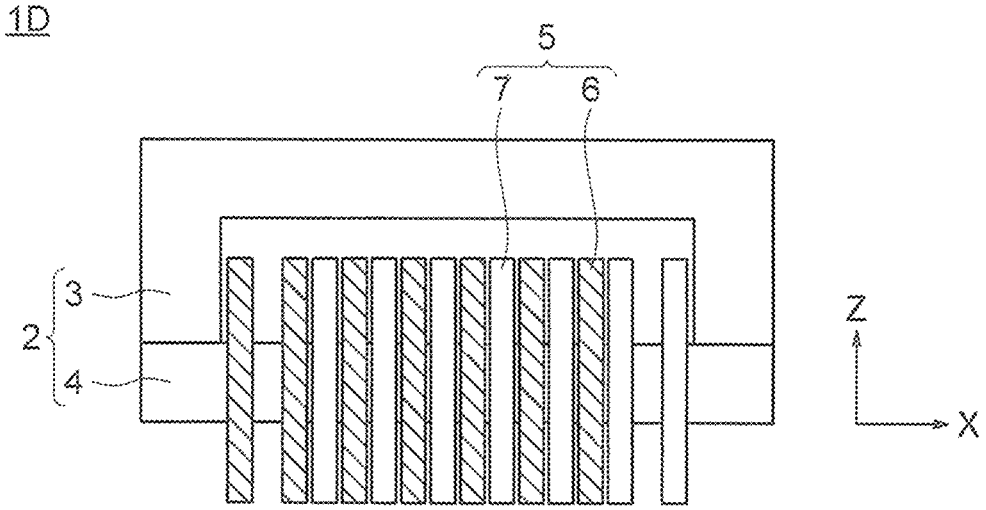
FIG. 17 is a front view for illustrating a common mode choke coil according to a fifth embodiment of the present invention.
Figure 18:
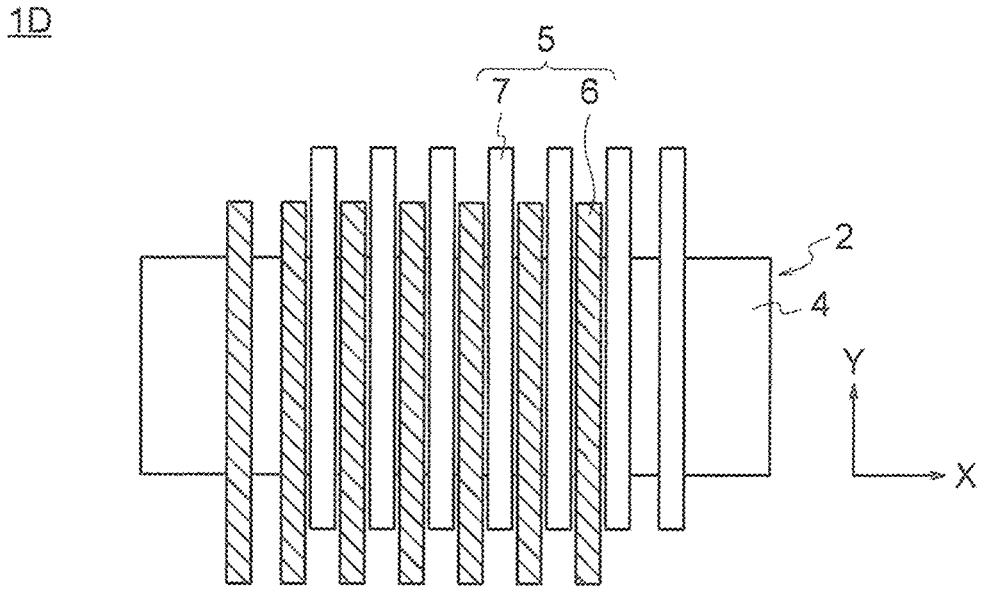
FIG. 18 is a bottom view for illustrating the common mode choke coil according to the fifth embodiment of the present invention.

FIG. 17 is a front view for illustrating a common mode choke coil according to a fifth embodiment for carrying out the present invention. FIG. 18 is a bottom view for illustrating the common mode choke coil according to the fifth embodiment.

In FIG. 17 and FIG. 18, the positive pole coil 6 and the negative pole coil 7 are formed by winding a copper rectangular conductor on the I-shaped core 4 in a spiral shape so that six turns of the seven turns are alternately arranged in the X direction.

The remaining configuration is the same as that of the first embodiment described above.

In a common mode choke coil 1D of the fifth embodiment, the positive pole coil 6 and the negative pole coil 7 are wound on the I-shaped core 4 of the magnetic core 2 in a spiral shape so that the respective turn portions are alternately arranged in the X direction. Further, the positive pole coil 6 and the negative pole coil 7 each include parallel running portions 11 that contribute to suppressing magnetic saturation, and non-parallel running portions 12 that contribute to the normal mode inductance. Therefore, also in the fifth embodiment, the same effects as those in the first embodiment described above are obtained.

In the common mode choke coil 1D, the positive pole coil 6 and the negative pole coil 7 are arranged on the I-shaped core 4 while being displaced by one turn in the X direction. That is, the positive pole coil 6 and the negative pole coil 7 are configured through combined use of the bifilar winding and the sectional winding, and hence it is possible to improve the performance of reducing the normal mode noise while suppressing magnetic saturation.

In the fifth embodiment described above, the positive pole coil 6 and the negative pole coil 7 are arranged so that six turns of the seven turns in total are alternately arranged in the X direction, and the remaining one turn is adjacent to its corresponding coil. That is, the positive pole coil 6 and the negative pole coil 7 are arranged so that six turns of the seven turns in total are each adjacent to a different pole coil, and the remaining one turn is adjacent to the same pole coil. However, the number of turns adjacent to a different pole coil out of the seven turns in total is not limited to six, and may be six to one. Further, the number of turns of each of the positive pole coil 6 and the negative pole coil 7 is not limited to seven. That is, the positive pole coil 6 and the negative pole coil 7 may be arranged so that M turns of N turns in total are each adjacent to a different pole coil, and (N−M) turns are each adjacent to the same pole coil. Here, N is an integer of 2 or more, and M is an integer of 1 or more and (N−1) or less.

Incidentally, when the positive pole coil 6 and the negative pole coil 7 include only the parallel running portion 11, the normal mode inductance can be adjusted only based on a ratio of the number of turns N and the number of turns M. Consequently, the normal mode inductance can only take a discrete value.

In the fifth embodiment, the positive pole coil 6 and the negative pole coil 7 each include the parallel running portions 11 and the non-parallel running portions 12, and hence the normal mode inductance can be adjusted to a desired value.

In the fifth embodiment described above, the positive pole coil 6 and the negative pole coil 7 in the common mode choke coil 1 of the first embodiment are arranged so that six turns of the seven turns in total are alternately arranged in the X direction, and the remaining one turn is adjacent to the same pole coil, but even when the positive pole coil and the negative pole coil in the common mode choke coil of the other embodiments are arranged so that six turns of the seven turns in total are alternately arranged in the X direction, and the remaining one turn is adjacent to the same pole coil, the same effects can be obtained.

Sixth Embodiment

Figure 19:
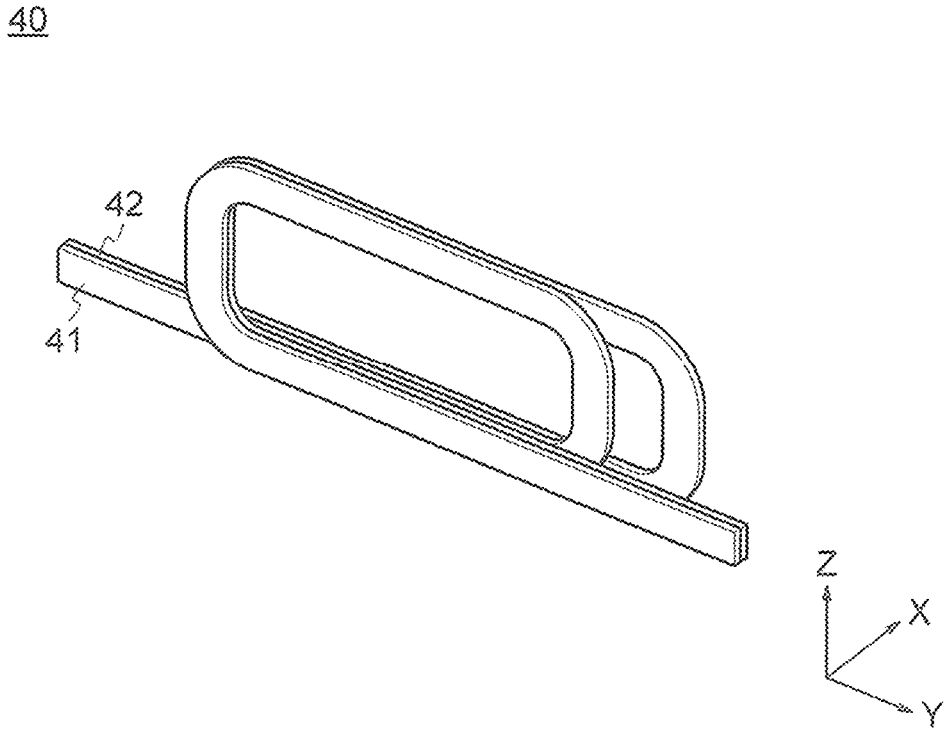
FIG. 19 is a perspective view for illustrating a pair of coils in a common mode choke coil according to a sixth embodiment of the present invention.
Figure 20:
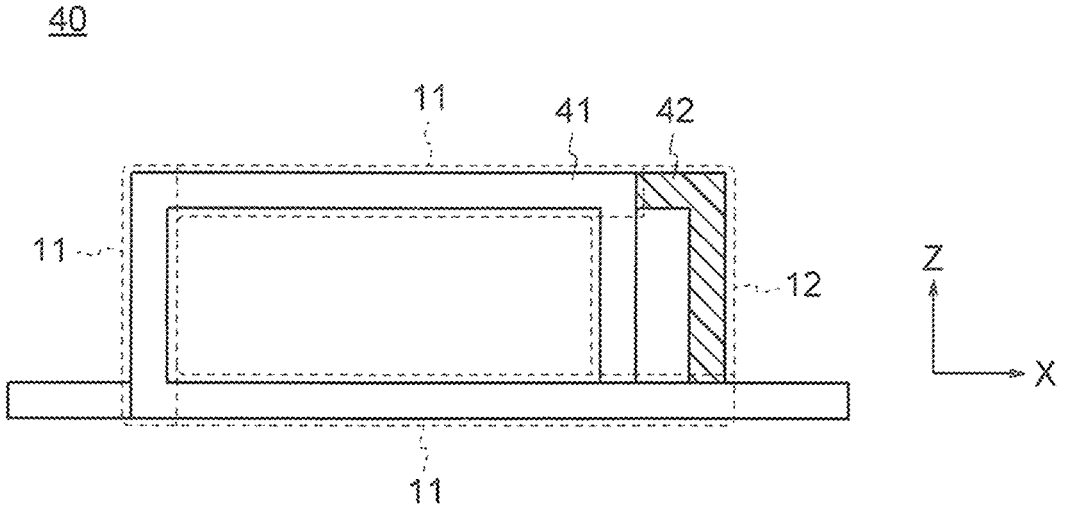
FIG. 20 is a side view for illustrating the pair of coils in the common mode choke coil according to the sixth embodiment of the present invention.

FIG. 19 is a perspective view for illustrating a pair of coils in a common mode choke coil according to a sixth embodiment for carrying out the present invention. FIG. 20 is a side view for illustrating the pair of coils in the common mode choke coil according to the sixth embodiment.

As illustrated in FIG. 19 and FIG. 20, a pair of coils 40 include a positive pole coil 41 being a one-turn first pole coil, and a negative pole coil 42 being a one-turn second pole coil. The positive pole coil 41 and the negative pole coil 42 are, although not shown, wound on the I-shaped core being a winding portion of the magnetic core so as to be adjacent to each other. Further, the positive pole coil 41 and the negative pole coil 42 each include parallel running portions 11 being overlapping regions and a non-parallel running portion 12 being a non-overlapping region. The positive pole coil 41 and the negative pole coil 42 overlap each other in the overlapping regions, and do not overlap each other in the non-overlapping region as viewed from the X direction.

The remaining configuration is the same as that of the first embodiment described above.

Also in the sixth embodiment, the one-turn positive pole coil 41 and the one-turn negative pole coil 42 are wound on the I-shaped core of the magnetic core so as to be adjacent to each other in the X direction. Further, the positive pole coil and the negative pole coil 42 each include, in one turn thereof, the parallel running portions 11 that contribute to suppressing the magnetic saturation and the non-parallel running portion 12 that contributes to the normal mode inductance. Therefore, also in the sixth embodiment, the same effects as those of the first embodiment described above are obtained.

As described in the sixth embodiment, also when the positive pole coil and the negative pole coil are one-turn coils, the effects of the present invention are obtained. Thus, according to the present invention, it is only required that the positive pole coil and the negative pole coil be wound in a spiral shape in the length direction of the I-shaped core by one or more turns, and that the positive pole coil and the negative electrode be arranged on the I-shaped core so that one or more turns are adjacent to each other, and each include the parallel running portion and the non-parallel running portion in at least one turn of the adjacent positive pole coil and negative pole coil.

Further, also in the sixth embodiment described above, similarly to the second embodiment described above, the metal casing 25 may be provided apart from the non-parallel running portion 12 of the pair of coils 40.

Further, also in the sixth embodiment described above, the auxiliary magnetic core 30 may be inserted into a space surrounded by the positive pole coil 41 and the negative pole coil 42 in the non-parallel running portion 12.

Further, also in the sixth embodiment described above, the metal plate 31 may be provided in the space surrounded by the positive pole coil 41 and the negative pole coil 42 in the non-parallel running portion 12 so as to be in contact with the positive pole coil 41 and the negative pole coil 42 via the insulator 32.

Further, in each of the embodiments described above, the magnetic core including the U-shaped core and the I-shaped core is adopted, but the magnetic core is not limited to the core obtained by combining the U-shaped core and the I-shaped core, and may be, for example, a core obtained by combining the U-shaped core and the U-shaped core, a toroidal core, or another core.

Further, in each of the embodiments described above, the copper rectangular conductor is used as materials for the positive pole coil and the negative pole coil, but other highly conductive materials, for example, an aluminum rectangular conductor may be used. Further, the rectangular conductor is used as materials for the positive pole coil and the negative pole coil, but a conductor having a circular sectional shape may be used.

Further, in each of the embodiments described above, the positive pole coil and the negative pole coil are formed into coils of a rectangular cylinder shape, but a coil shape is not limited to the rectangular cylinder shape.

REFERENCE SIGNS LIST

2 magnetic core, 4 I-shaped core (winding portion), 5 pair of coils, 6 positive pole coil, 7 negative pole coil, 11 parallel running portion, 12 non-parallel running portion, 21 pair of coils, 22 positive pole coil, 23 negative pole coil, 25 metal casing (metal member), 30 auxiliary magnetic core, 31 metal plate (heat radiating member), 40 pair of coils, 41 positive pole coil, 42 negative pole coil

The invention claimed is:

1. A common mode choke coil, comprising:

a magnetic core; and a pair of coils wound on a winding portion of the magnetic core, wherein the pair of coils include a first pole coil and a second pole coil having a rectangular cylinder shape which are each wound on the winding portion in a spiral shape by N turns in a length direction of the winding portion, wherein the first pole coil and the second pole coil are arranged on the winding portion so that a plurality of turns of the N turns are adjacent to each other, wherein the adjacent first pole coil and second pole coil each include a parallel running portion and a non-parallel running portion, the first pole coil and the second pole coil overlapping each other in the parallel running portion, and separating from each other in a direction orthogonal to the length direction of the winding portion in the non-parallel running portion when the plurality of turns of the first pole coil and the second pole coil are viewed from the length direction of the winding portion, where N is an integer of 2 or more, and wherein the adjacent first pole coil and second pole coil each include the parallel running portions on two opposing sides of four sides that define the rectangular cylinder shape.

2. A common mode choke coil, comprising:

a magnetic core;

a pair of coils wound on a winding portion of the magnetic core; and a metal member configured to hold an outer peripheral portion of the pair of coils located on one side of the winding portion as viewed from a length direction of the winding portion, wherein the pair of coils include a first pole coil and a second pole coil which are each wound on the winding portion in a spiral shape by N turns in the length direction of the winding portion, wherein the first pole coil and the second pole coil are arranged on the winding portion so that one or more turns of the N turns are adjacent to each other, and the first pole coil and the second pole coil each include a parallel running portion and a non-parallel running portion, the first pole coil and the second pole coil overlapping each other in the parallel running portion, and separating from each other in a direction orthogonal to the length direction of the winding portion in the non-parallel running portion in at least one turn of the adjacent first pole coil and second pole coil as viewed from the length direction of the winding portion, and wherein the non-parallel running portion is provided on an opposite side to the metal member, of the winding portion of the pair of coils, where N is an integer of 1 or more.

3. The common mode choke coil according to claim 2, wherein the metal member is a heat sink configured to cool the pair of coils.

4. A common mode choke coil, comprising:

a magnetic core; and a pair of coils wound on a winding portion of the magnetic core, wherein the pair of coils include a first pole coil and a second pole coil which are each wound on the winding portion in a spiral shape by N turns in a length direction of the winding portion, wherein the first pole coil and the second pole coil are arranged on the winding portion so that a plurality of turns of the N turns are alternately arranged, and the first pole coil and the second pole coil each include a parallel running portion and a non-parallel running portion, the first pole coil and the second pole coil overlapping each other in the parallel running portion, and separating from each other in a direction orthogonal to the length direction of the winding portion in the non-parallel running portion in the plurality of turns of the first pole coil and the second pole coil as viewed from the length direction of the winding portion, where N is an integer of 2 or more, and wherein the common mode choke coil further comprises an auxiliary magnetic core inserted into a space surrounded by the non-parallel running portion.

5. A common mode choke coil, comprising:

a magnetic core; and a pair of coils wound on a winding portion of the magnetic core, wherein the pair of coils include a first pole coil and a second pole coil which are each wound on the winding portion in a spiral shape by N turns in a length direction of the winding portion, wherein the first pole coil and the second pole coil are arranged on the winding portion so that one or more turns of the N turns are adjacent to each other, and the first pole coil and the second pole coil each include a parallel running portion and a non-parallel running portion, the first pole coil and the second pole coil overlapping each other in the parallel running portion, and separating from each other in a direction orthogonal to the length direction of the winding portion in the non-parallel running portion in at least one turn of the adjacent first pole coil and second pole coil as viewed from the length direction of the winding portion, and wherein the common mode choke coil further comprises a heat radiating member inserted into a space surrounded by the non-parallel running portion, where N is an integer of 1 or more.

6. The common mode choke coil according to claim 1, wherein the first pole coil and the second pole coil each include the parallel running portions on the two opposing sides and further on another side.

* * * * *